United States Patent [19]

Nomoto et al.

[11] Patent Number: 4,945,842

[45] Date of Patent: Aug. 7, 1990

[54] EMBROIDERING SEWING MACHINE

[75] Inventors: Reishi Nomoto; Hideaki Takenoya, both of Tokyo, Japan

[73] Assignee: Janome Sewing Machine Co. Ltd., Tokyo, Japan

[21] Appl. No.: 262,296

[22] Filed: Oct. 24, 1988

[30] Foreign Application Priority Data

Oct. 30, 1987 [JP] Japan ..... 62-273238

[51] Int. Cl.[5] ..... D05C 9/04; D05B 21/00

[52] U.S. Cl. ..... 112/103; 112/121.12

[58] Field of Search ..... 112/121.12, 103, 102, 112/121.11, 456, 458, 453, 262.3, 266.1

[56] References Cited

U.S. PATENT DOCUMENTS

| | | | |
|---|---|---|---|
| 4,444,134 | 4/1984 | Maruyama et al. | 112/121.12 |
| 4,763,586 | 8/1988 | Takenoya et al. | 112/103 |
| 4,768,450 | 9/1988 | Kato et al. | 112/121.12 |
| 4,823,714 | 4/1989 | Yokoe et al. | 112/121.12 X |

*Primary Examiner*—Peter Nerbun

*Attorney, Agent, or Firm*—Michael J. Striker

[57] ABSTRACT

An embroidering machine which comprises a device for adjusting a size of a selected pattern, a device for storing the adjusted size, and an arrangement for storing upper and lower critical sizes of the selected pattern. The embroidering machine according to the invention further comprises a discriminating device for determining if the adjusted size of the selected pattern is larger or smaller than the upper or lower critical size of the selected pattern. There is further provided a control unit which, in response to determination that the adjusted size of the selected pattern is larger or smaller than the upper critical size of the selected pattern or larger or smaller than the lower critical size of the selected pattern, calculates data for controlling the positions of a fabric holding frame carrying a cloth to be embroidered with respect to a vertically reciprocating needle.

2 Claims, 5 Drawing Sheets

EMBROIDERING SEWING MACHINE

BACKGROUND OF THE INVENTION (a) Field of the Invention

The present invention relates to an embroidering sewing machine and, more particularly, to an embroidering machine for altering an embroidering stitch type in dependence on a size of a pattern to be formed.

(b) Description of the Prior Art

An embroidering machine for forming a pattern by arbitrarily altering the size of the pattern selected from a plurality of different patterns stored in a memory in a form of pattern information, is generally known.

In an embroidering machine which can alter the size of a selected pattern stored in advance, when the size of the pattern is altered or adjusted beyond a critical size, it may happen that an embroidering frame carrying a fabric to be sewed will not move in synchronism with a vertically reciprocating needle, especially when the pattern is to be formed with a so-called type of satin stitches shown in FIG. 7(*a*), that is, zigzag stitches with a close feed pitch.

In this case, a special mechanism for disconnecting the needle bar from the drive shaft of the sewing machine is used.

The needle bar remains disconnected until the fabric holding frame is correctly positioned under the needle. However, since the fabric holding frame is required to move a distance with respect to the needle stopped in a position above the fabric, the thread may get twisted, loosen, or may get caught by the needle point and damaged or cut off. In any event, it is difficult to obtain a desired seam; in particular, the satin stitches shown in FIG. 7(*a*) when the adjusted size of the selected pattern is beyond a predetermined critical size.

In a conventional embroidering machine that does not have a mechanism for disconnecting the needle bar from the drive shaft, the fabric-holding frame is displaced in a plurality of steps with each step synchronized with the vertical reciprocation of the needle of a set amplitude when the set amplitude is beyond a critical amplitude, so that mat-type stitches, shown in FIG. 7(*b*), may be formed.

However, if a section of satin stitches and a section of mat-type stitches are mixed in one pattern, the appearance of a sewn pattern is adversely affected.

On the other hand, when the size of the pattern is altered to a degree which is smaller than the critical size of the pattern the sewing width of the pattern is continuously narrowed until the stitches become substantially straight stitches dependent on how the adjustment was effected.

In this case, the needle is liable to repeatedly drop relative to the same position of the fabric. As a result, the needle will damage the seams and often will cut the seams. Japanese Patent Application 61-33788 of the applicants herein discloses a method for automatically enlarging a stitch width in such a case. However, this is different from the invention of the subject application which relates to forming large and small size patterns.

SUMMARY OF THE INVENTION

The object of the invention is an embroidering machine for sewing a selected pattern having different types of stitches dependent on an adjusted size of the pattern. According to the invention, when the stitch amplitude is adjusted beyond an upper critical size, the amplitude is traversed with the mat-type stitches as shown in FIG. 7(*b*). When the adjusted stitch amplitude is below the upper critical size and below a lower critical size, the amplitude is traversed with the satin stitches shown in FIG. 7(*a*).

The object of the invention is achieved by providing a computerized embroidering machine having stitch-forming means that includes a vertically reciprocating needle carrying an upper thread and a loop taker carrying a lower thread and rotatable in synchronism with the needle to form stitches with upper and lower threads in cooperation with the needle. The embroidering machine according to the invention further includes fabric holder means including a frame carrying thereon a fabric to be embroidered, and drive means for driving the fabric holder means in a horizontal plane in X- and Y- directions with respect to and in synchronism with the vertically reciprocating needle. The embroidering machine according to the invention further includes memory means for storing a plurality of different patterns in a form of pattern data and pattern selecting means having a plurality of selectively operating keys for selecting pattern data corresponding to a selected pattern for controlling operation of the drive means. The embroidering machine according to the invention also includes pattern size adjusting means for adjusting the size of the selected pattern, pattern size storing means for storing the adjusted size of the selected pattern, and reference pattern size storing means for storing an upper critical size of the selected pattern. There are also provided in the embroidering machine according to the present invention, stitch forming data storing means for storing first stitch data for controlling reciprocating movement of the fabric holding means in the X-direction with a single step of a predetermined amplitude per each vertical reciprocation of the needle while the fabric holding means moves in the Y-direction with a predetermined pitch, and second stitch data for controlling movement of the fabric holding means in the X-direction in a plurality of steps with each step being in synchronism with vertical reciprocation of the needle across a predetermined amplitude while the fabric holding means moves in the Y-direction with a predetermined pitch. There is also provided discriminating means for determining if the adjusted size of the selected pattern is larger or smaller than the upper critical size of the selected pattern. Control means in response to determination by the discriminating means that the adjusted size of the selected pattern is larger than the upper critical size of the selected pattern, calculates on the basis of the selected pattern data and the second stitch data, in accordance with the pattern size adjusting rate, data for controlling positions of the fabric holding means with respect to the vertically reciprocating needle. If the discriminating means determines that the adjusted size of the selected pattern is smaller than the upper critical size of the selected pattern, the control means calculates on the basis of the selected pattern data and the first stitch data, in accordance with the pattern size adjusting rate, data for controlling the positions of the fabric holding means with respect to the vertically reciprocating needle.

According to the present invention, there is further provided a second reference pattern size storing means for storing a lower critical size of the selected pattern, and the discriminating means determines whether the adjusted size of the selected pattern is larger or smaller than the lower critical size of the selected pattern. The control means, in response to the discriminating means determining that the adjusted size of the selected pattern is larger than the lower critical size of the selected pattern, calculates on the basis of the selected pattern data and the first stitch data in accordance with the pattern size adjusting rate, data for controlling the positions of the fabric holding means relative to the vertically reciprocating needle. In response to the discriminating means determining that the adjusted size of the selected pattern is smaller than the lower critical size of the selected pattern, the control means calculates, on the basis of the selected pattern data and the second stitch data, in accordance with the pattern size adjusting rates, data for controlling the positions of the fabric holding means relative to the vertically reciprocating needle.

The above and other objects of the invention will be apparent by those skilled in the art from a reading of the following detailed description of the disclosure found in the accompanying drawings and novelty thereof pointed out in the appended claims.

DETAILED DESCRIPTION OF THE PREFERRED EMBODIMENTS

An embodiment of an embroidering machine according to the present invention will be described with reference to the accompanying drawings.

Figure 4:
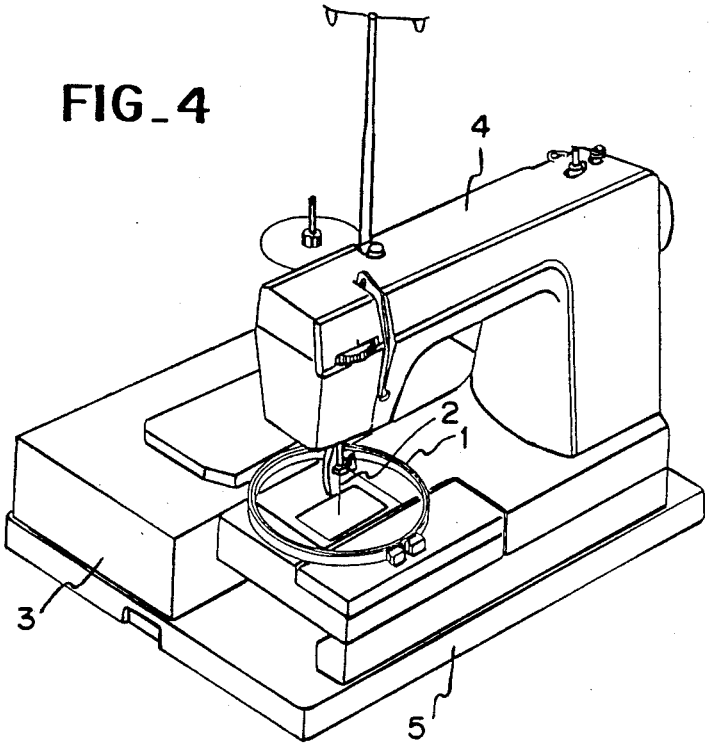
FIG. 4 is an external view of the embroidering machine.

In FIG. 4, reference numeral 1 denotes an embroidering frame which is so disposed as to contain a needle 2 which reciprocates vertically relative to the frame 1 for holding an object to be embroidered, such as cloth. Reference numeral 3 denotes a driving mechanism for controlling the displacement of the embroidering frame 1 in X- and Y-directions.

Means for sewing cloth with an embroidering yarn comprises the needle 2 which reciprocates vertically, and a lower yarn container (not shown). In a sewing machine body 4 itself, cloth feeding teeth and a cloth retainer of an ordinary domestic sewing machine are absent though the sewing machine belongs to a category of so-called linear sewing machines. The machine body 4 and the X-Y-directional driving mechanism 3 are clamped with bolts on a base 5.

Inside of the X-Y directional driving mechanism 3, there are located an X-directional driving stepping motor, as will be described later, an Y-directional driving stepping motor, a mechanism driven by both the X- and Y-directional stepping motors, a power switch, a power transformer, a power source circuit, and a driver circuit for the stepping motors, etc.

Figure 5:
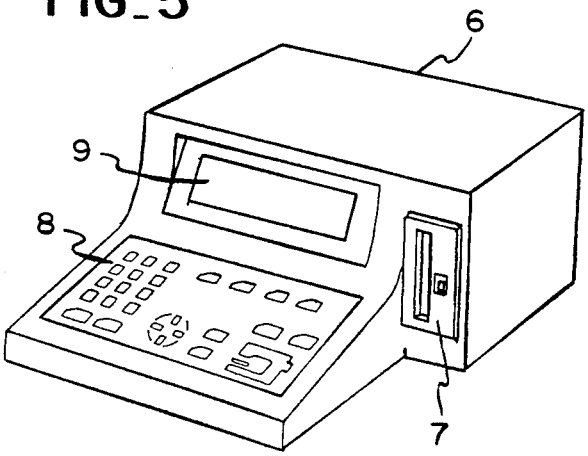
FIG. 5 is an external view of a control box.

In FIG. 5, reference numeral 6 denotes a control box for controlling and managing the operations of all the components and units in the sewing body 4, which includes external information storage means 27 with a floppy disk driver 7, a key panel 8, and an LCD display unit 9, as well as various electronic control circuits.

The electronic circuits receive power and communicate various signals to the body 4 through a wire cable. Pattern data for embroidering are written on an ordinary floppy disk at the stage of forming original data, and necessary data are read by inserting by a user for the embroidering machine into the floppy disk driver 7.

Figure 6:
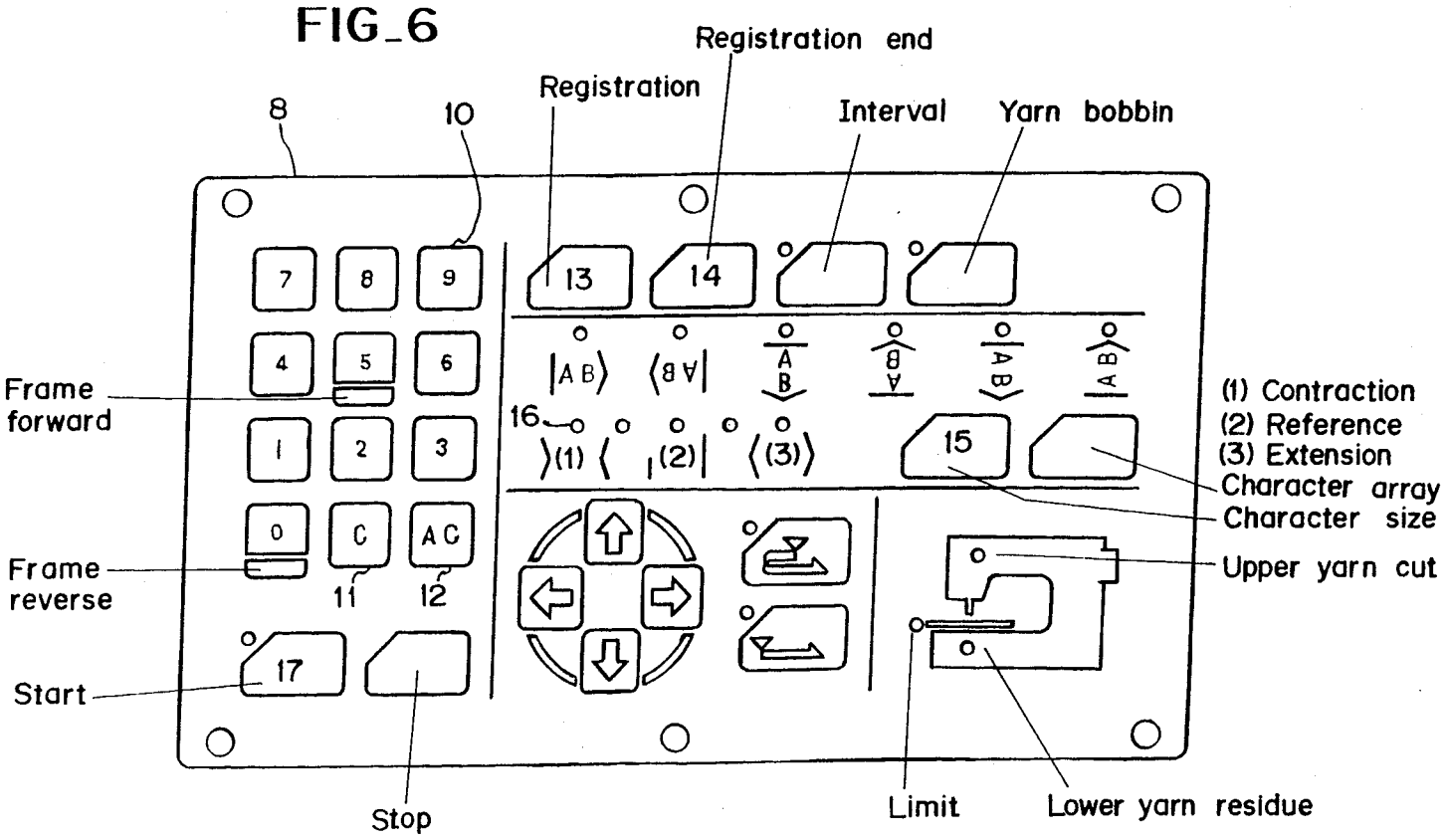
FIG. 6 is an explanatory view of a key panel of the control box.

FIG. 6 is an explanatory view of the key panel 8. Numeric keys 10 constitute pattern selecting means 28 used for selecting a pattern number corresponding to a desired pattern.

Reference numeral 11 denotes a clear key C used to clear an error input by the numeric key or keys 10 and to reset to a sewing origin during the stoppage of sewing on the way. Numeral 12 denotes an all clear key AC used to all clear selected characters and numbers registered and stored by the numeric key or keys 10 and a registration key, and a registration end key to be described later and to automatically reset to a frame origin.

Numeral 13 denotes a registration key for registering a pattern number by depressing it after a pattern number is selected. The registration end key 14 is to be depressed after the registrations of all the pattern numbers of the pattern to be embroidered are finished. Thus, from the floppy disk 7 of the external information storage means, are read desired pattern embroidering data, pattern display data, pattern extension and contraction rate data, and other managing data, etc.

Numeral 15 denotes a pattern size key of pattern size adjusting means 29 for altering the size of a pattern to be sewed, and when the key is repeatedly depressed, the sizes of the extension, a reference, the contraction can be sequentially selected. The selected size can be discriminated by an LED 16 on a size index. In the embodiment described above, 5 stages are prepared, but more stages may be provided as required.

Numeral 17 denotes a start key depressed for shifting to an embroidering operation after the desired pattern number is registered or finished to be registered.

Figure 1:
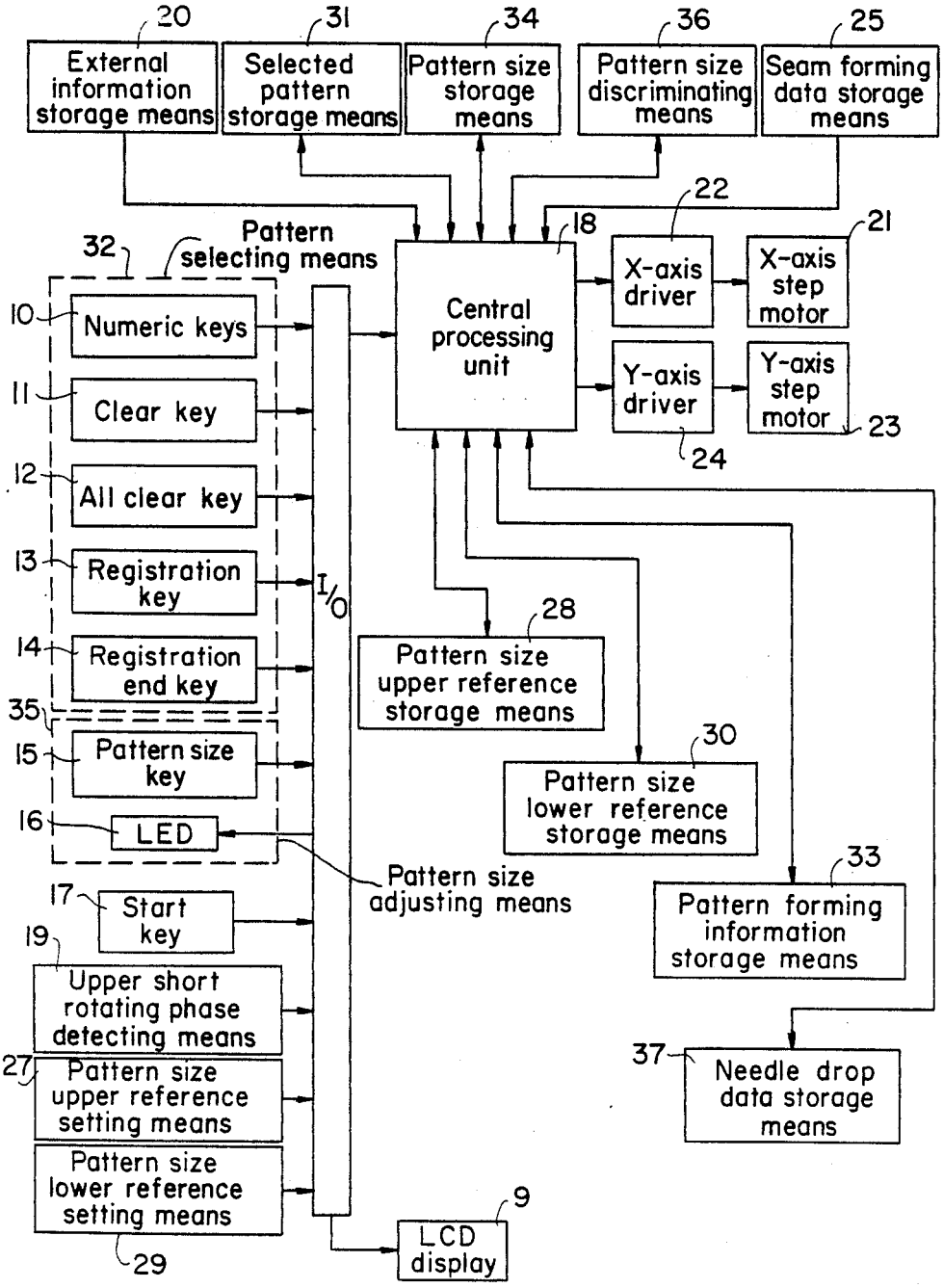
FIG. 1 is a control block diagram showing an embodiment of an embroidering machine according to the present invention.

A control circuit shown in FIG. 1 will now be described.

Reference numeral 18 denotes a central processing unit (CPU) formed as a general microprocessor. An I/O denotes a programmable input/output interface to communicate data between a peripheral unit and the central processing unit 18.

Numeral 19 denotes upper shaft rotating phase detecting means in the embroidering machine for detecting a brake signal output phase, and an X-Y-direction driving phase. The brake signal output phase is set near a balance top dead point phase of the embroidering machine, and the X-Y-directional driving phase, i.e., an embroidering frame driving phase is set to a phase in which the needle 2 is disposed above the cloth to be embroidered.

Numeral 21 denotes an X-axis stepping motor which is stepwisely driven by a pulse from an X-directional driver 22. Numeral 23 denotes a Y-directional stepping motor which is driven by an Y-directional driver 24.

Numeral 27 denote pattern size upper reference setting means for selecting the size of the upper reference as a base of an operation, to store and set it in pattern size upper reference storage means 28.

Numeral 29 denotes pattern size lower reference setting means for similarly selecting the size of the lower reference as a base of an operation to store and set it in pattern size lower reference storage means 30.

Numeral 31 denotes selected pattern storage means connected to the central processing unit 18 for storing a pattern number selected with ten keys 10 of pattern selecting means 32. Numeral 33 denotes pattern forming information storage means for storing pattern forming information read from the external storage means 20 for the pattern corresponding to the selected character number, by manipulating the registration key 13.

Numeral 34 denotes pattern size storage means for storing the size adjusted value of the selected pattern selected with the pattern size key 15 of the pattern size adjusting means 35.

Numeral 36 denotes pattern size discriminating means that compare the size of the pattern stored in the pattern size storage means 34 with the size of the pattern stored in the pattern size upper reference storage means and the pattern size lower reference storage means. The discriminating means compares, when the setting means is not operated, the size of the pattern stored in the pattern size storage means with standard upper and lower reference contained in control information data group contained among the pattern forming information.

Numeral 37 denotes needle drop data storage means for storing needle drop data calculated according to the pattern forming information stored in the pattern forming information storage means 33, and the pattern size adjusted value.

The controlling operation of the embroidering machine constituted as described above will now be described.

Figure 2:
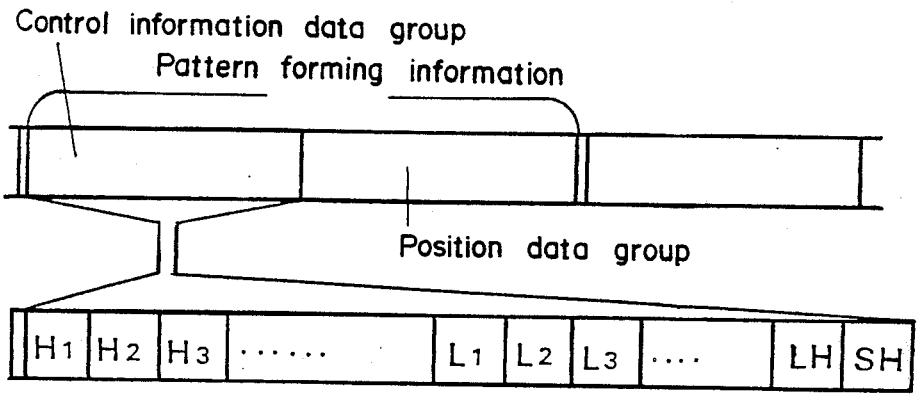
FIG. 2 is an explanatory view of a method of storing control information.
Figure 7A:
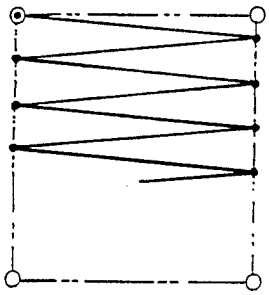
FIG. 7 is an explanatory view of embroidering means of the pattern.
Figure 7B:
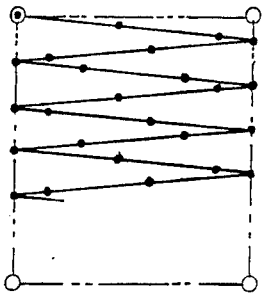

The ten keys 10 of the pattern selecting means are selectively operated, and the registration key is operated to store the pattern number in the selected pattern storage means 29. The registration end key is operated to read the pattern forming information corresponding to the pattern number stored in the selecting means 29 from the floppy disk driver of the external memory, and to store it in the pattern forming information storage means. The pattern forming information has a structure as shown in FIG. 2, and consists of a control information data group necessary for controlling embroidery, and position data group indicating a pattern shape to be embroidered.

The control information data group contains data H indicating the size of the pattern to be embroidered, data L indicating the extension or contraction rate when the pattern is extended or contracted, and standard upper and lower references LH and SH of the point for altering the pattern sewing method.

Figure 3:
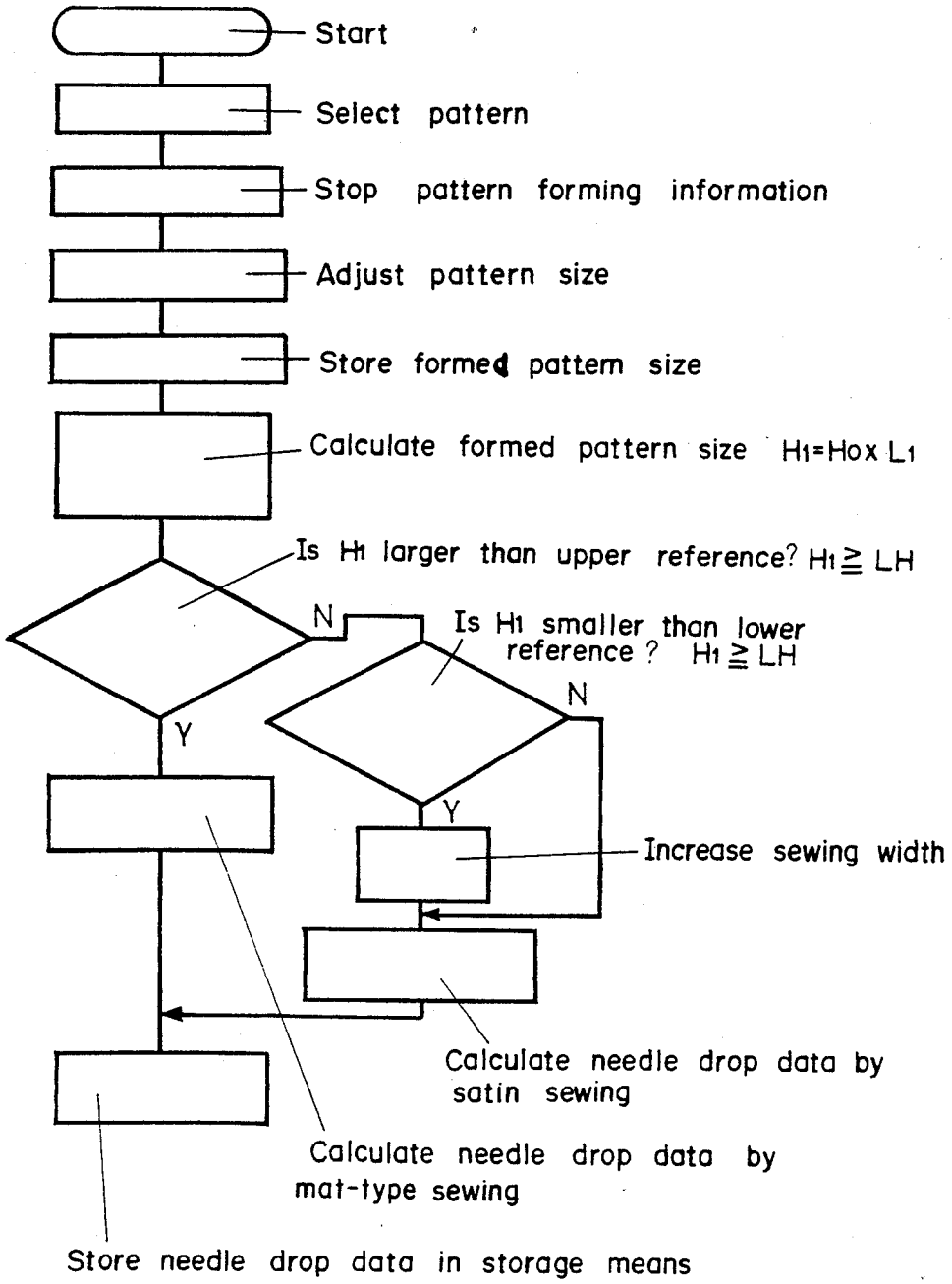
FIG. 3 is an explanatory view of an operation of controlling the machine.

The character size key of the pattern size setting means is then operated for the selected pattern as described above to set the size of the pattern. The pattern discriminating means and the central processing unit are operated, as shown in FIG. 3, in response to the size of the set pattern.

More specifically, when the extension or contraction rate of the pattern is inputted by the pattern size setting means, one data L indicating the corresponding extension or contraction rate, is selected from the control information data group, stored in the pattern size storage means, and the size of the pattern to be formed, such as the height $H_1$ of the pattern is, for example, obtained by multiplying the pattern height data $H_0$ stored as the reference size, by the extention or contraction rate $L_1$, resulting as $H_1 = H_0 \times L_1$.

The value $H_1$ is compared by the pattern discriminating means with the above-described upper reference LH. When the adjusted value $H_1$ is larger than the standard upper reference LH, it is recognized as being larger than the upper limit size, and outputted to the central processing unit 18. The central processing unit 18 calculates needle dropping data in accordance with the position data group indicating the pattern shape to be embroidered, and the seam forming data of the mat-type sewing stored in the seam forming data storage means, and stores it in the needle drop data storage means 37.

Then, the central processing unit 18 reads the needle dropping data from the needle drop data storage means 37 in response to the detection signal of the upper shaft rotational phase detecting means by operation of the start key 17, and outputs a control signal to the X-directional driver 22 and the Y-directional driver 24.

The X-directional driver 22 and the Y-directional driver 24 generate pulse signals to drive the X-directional stepping motor 21 and the Y-directional stepping motor 23 to form the pattern by satin sewing.

When the adjusted value $H_1$ is smaller than the standard upper reference LH and smaller than the standard lower reference SH, the discriminating means recognize it as being smaller than the lower limit size, and outputs it to the central processing unit 18. The central processing unit 18 calculates the needle dropping data by the satin sewing corrected to extend the seam width with the position data group indicating the pattern shape to be embroidered, the seam forming data of satin sewing stored in the seam forming data storage means 25, and the seam width correcting data, and outputs the needle dropping data to store it in the needle data storage means 37.

Then, the central processing unit 18 reads the needle dropping data from the needle drop data storage means 27 in response to the detection signal of the upper shaft phase detecting means, and outputs control signals to the X-directional driver 22 and the Y-directional driver 24.

The X-directional driver 22 and the Y-directional driver 24 generate pulse signals to drive the Y-directional stepping motor 21 and the X-directional stepping motor 23, thereby forming a pattern by the satin sewing in which the sewing width is increased.

In the embodiment described above, the pattern size upper reference setting means 27 and the pattern size lower reference setting means 29 are not operated, and the size is compared with the reference value contained in the control information data group. However, when the pattern size upper reference setting means 27 and the pattern size lower reference setting means 29 are operated, the set values are stored in the pattern size upper reference storage means 28 and the pattern size lower reference storage means 30, and the discriminating means 36 compares the adjusted value $H_1$ with these set values.

According to the present invention as described above, the embroidering machine can discriminate the size of the selected pattern of the adjusted size to alter the embroidering method to obtain a different seam, such as the satin seam or the mat-type seam in response to the size of the pattern, and can increase the sewing width in response to the small pattern. Therefore, when the pattern is increased in size, no defect in the external appearance, such as different sewing seams in one pattern, is eliminated. Since the seam is not formed by one needle at a long extent different from the satin sewing, a seam resistant against an external force, can be formed. When the pattern is decreased in size, the sewing width is reduced by the contraction rate, a defect of decreased embroidering effect in the external appearance is eliminated, and the seam adapted for the pattern to be formed can be automatically set and formed.

What is claimed is:

1. An embroidering machine comprising stitch forming means including a vertically reciprocating needle carrying an upper thread and a loop taker carrying a lower thread and rotatable in synchronism with needle movement to form, in cooperation with the needle, stitches with upper and lower threads; fabric holder means including a frame for carrying a fabric mounted thereon; drive means for driving the fabric holder means in a horizontal plane in X- and Y-directions relative to and in synchronism with reciprocational movement of said needle; memory means for storing a plurality of different patterns in a form of pattern data; pattern selecting means including a plurality of selectively operated keys for selecting pattern data corresponding to a selected pattern for controlling operation of said drive means; means for adjusting a size of the selected pattern; means for storing an adjusted size of the selected pattern; first reference pattern size storing means for storing an upper critical size of the selecting pattern; means for storing first stitch data for displacing said fabric holding means in the X-direction in a single step of a predetermined amplitude per each vertical reciprocation of said needle while moving said fabric holding means in the Y-direction with a predetermined pitch, and second stitch data for displacing said fabric holding means in the X-direction in a plurality of steps each in synchronism with the vertical reciprocation of the needle across a predetermined amplitude while moving said fabric holding means in the Y-direction with a predetermined pitch; discriminating means for determining if the adjusted size of the selected pattern is larger or smaller than the upper critical size of the selected pattern; and control means which, in response to said discriminating means determining that the adjusted size of the selected pattern is larger than the upper critical size of the selected pattern, calculate on the basis of the selected pattern data and the second stitch data, in accordance with the pattern size adjusting rate, data for controlling positions of said fabric holding means with respect to said vertically reciprocating needle, and, in response to said discriminating means determining that the adjusted size of the selected pattern is smaller than the upper critical size of the selected pattern, calculate on the basis of the selected pattern data and the first stitch data, in accordance with the pattern size adjusting rate, data for controlling the positions of said fabric holding means with respect to said vertically reciprocating needle.

2. An embroidering machine as defined in claim 1, further comprising second reference pattern size storing means for storing a lower critical size of the selected pattern, said discriminating means determining if the adjusted size of the selected pattern is larger or smaller than the lower critical size of the selected pattern; and said control means, in response to said discriminating means determining that the adjusted size of the selected pattern is larger than the lower critical size of the selected pattern, calculating on the basis of the selected pattern data and the first stitch data, in accordance with the pattern size adjusting rate, data for controlling the positions of said fabric holding means with respect to the vertically reciprocating needle, and, in response to said discriminating means determining that the adjusted size of the selected pattern is smaller than the lower critical size of the selected pattern, calculating on a basis of the selected pattern data and the second stitch data, in accordance with the pattern size adjusting rate, data for controlling the positions of said fabric holding means with respect to said vertically reciprocating needle.

* * * * *